US005580022A

United States Patent [19]

Bach et al.

[11] Patent Number: 5,580,022

[45] Date of Patent: Dec. 3, 1996

[54] DISPLAY PLATFORM

[75] Inventors: Gary M. Bach, Appleton; James E. Buchman, Hortonville, both of Wis.

[73] Assignee: Reynolds Consumer Products Inc., Appleton, Wis.

[21] Appl. No.: 419,222

[22] Filed: Apr. 10, 1995

[51] Int. Cl.[6] ..... A47B 91/00

[52] U.S. Cl. ..... 248/346.01; 248/903; 108/152; 211/134

[58] Field of Search ..... 248/346.01, 357, 248/346.02, 346.3, 346.4, 903, 910; 211/90, 128, 134, 186, 188, 153; 108/901, 152

[56] References Cited

U.S. PATENT DOCUMENTS

| | | | |
|---|---|---|---|
| D. 218,244 | 8/1970 | Hansen | D33/14 |
| 3,478,892 | 11/1969 | Lockwood | 211/126 |
| 3,939,987 | 2/1976 | Bustos et al. | 211/134 |
| 4,103,857 | 8/1978 | Levenhagen | 248/346.02 |
| 4,183,491 | 1/1980 | Sanders et al. | 248/346.02 |
| 4,463,684 | 8/1984 | Klungle et al. | 108/91 |
| 4,815,394 | 3/1989 | Ettlinger et al. | 108/901 |
| 4,869,456 | 9/1989 | Jacobs | 108/901 |
| 4,919,282 | 4/1990 | Duff et al. | 211/134 |
| 4,946,725 | 8/1990 | Harlan | 248/346.01 |
| 4,976,360 | 12/1990 | Zucker et al. | 211/188 |
| 5,140,914 | 8/1992 | Bohbot et al. | 108/152 |

FOREIGN PATENT DOCUMENTS 2425823 5/1978 France .

*Primary Examiner*—Karen J. Chotkowski
*Assistant Examiner*—Anita M. Kingak
*Attorney, Agent, or Firm*—Alan T. McDonald

[57] ABSTRACT

A unitary molded plastic display platform comprises a flat horizontal deck for supporting items thereon, a pair of generally parallel opposing vertical side faces, a vertical front face bridging the opposing side faces, and a vertical support leg disposed between the opposing side faces. The display platform is preferably free of a vertical rear face opposing the front face so that the display platform forms an opening at its rear beneath the horizontal deck. The support leg is generally parallel to the opposing side faces. The side faces and the support leg are generally perpendicular to the front face and extend rearward from the front face. The length of the support leg is less than the lengths of the respective side faces. The opposing side faces, the front face, and the support leg extend downward by substantially the same extent from the flat horizontal deck. The display platform is intended to be used in the retail business to promote retail products which require more display space than can be provided by conventional shelves located on stand alone displays or end aisle displays.

22 Claims, 4 Drawing Sheets

DISPLAY PLATFORM

FIELD OF THE INVENTION

The present invention generally relates to platforms for displaying retail products and, more particularly, relates to a display platform for adding display space on a retail floor.

BACKGROUND OF THE INVENTION

In many retail stores, it is desirable to promote certain retail products by exhibiting these products on shelves located on stand alone displays or at the end of retail aisles. Such stand alone displays and end aisle displays often do not provide sufficient display space to accommodate a large quantity of promoted products. Heretofore, additional display space has been provided by modifying the configuration of the display shelves. Unfortunately, making such modifications can be a time-consuming process and can require numerous mechanical tools because typical shelves are mechanically fastened to vertical support walls by means such as bolts or screws. Moreover, even if the display space is expanded by changing the configuration of the display shelves, the expanded display shelves are often too flimsy and weak to support heavier retail products.

Accordingly, a need exists for a display platform for expanding display space which overcomes the aforementioned drawbacks associated with existing stand alone displays and end aisle displays.

SUMMARY OF THE INVENTION

One embodiment of the present invention provides a unitary display platform comprising a flat horizontal deck for supporting items thereon, a pair of generally parallel opposing vertical side faces, a vertical front face bridging the opposing side faces, and a vertical support leg disposed between the opposing side faces. The display platform is preferably free of a vertical rear face opposing the front face so that the display platform forms an opening at its rear beneath the horizontal deck. The support leg is generally parallel to the opposing side faces. The side faces and the support leg are generally perpendicular to the front face and extend rearward from the front face. The length of the support leg is less than the lengths of the respective side faces. The opposing side faces, the front face, and the support leg extend downward by substantially the same extent from the flat horizontal deck. In a preferred embodiment, the display platform is composed of molded plastic.

The foregoing display platform is preferably used to provide stand alone displays or to increase the display space of retail end aisle displays. With respect to an end aisle display, the display platform is placed over an existing lower shelf of the end aisle display with the existing lower shelf protruding through the opening at the rear of the display platform. The rear opening is defined by the opposing vertical side faces and the horizontal deck. The shelf is located sufficiently close to the floor so that the shelf is positioned beneath the horizontal deck while the display platform rests on a floor. The shelf preferably supports a rear portion of the horizontal deck.

BRIEF DESCRIPTION OF THE DRAWINGS

Other objects and advantages of the invention will become apparent upon reading the following detailed description and upon reference to the drawings in which.

Figure 1:
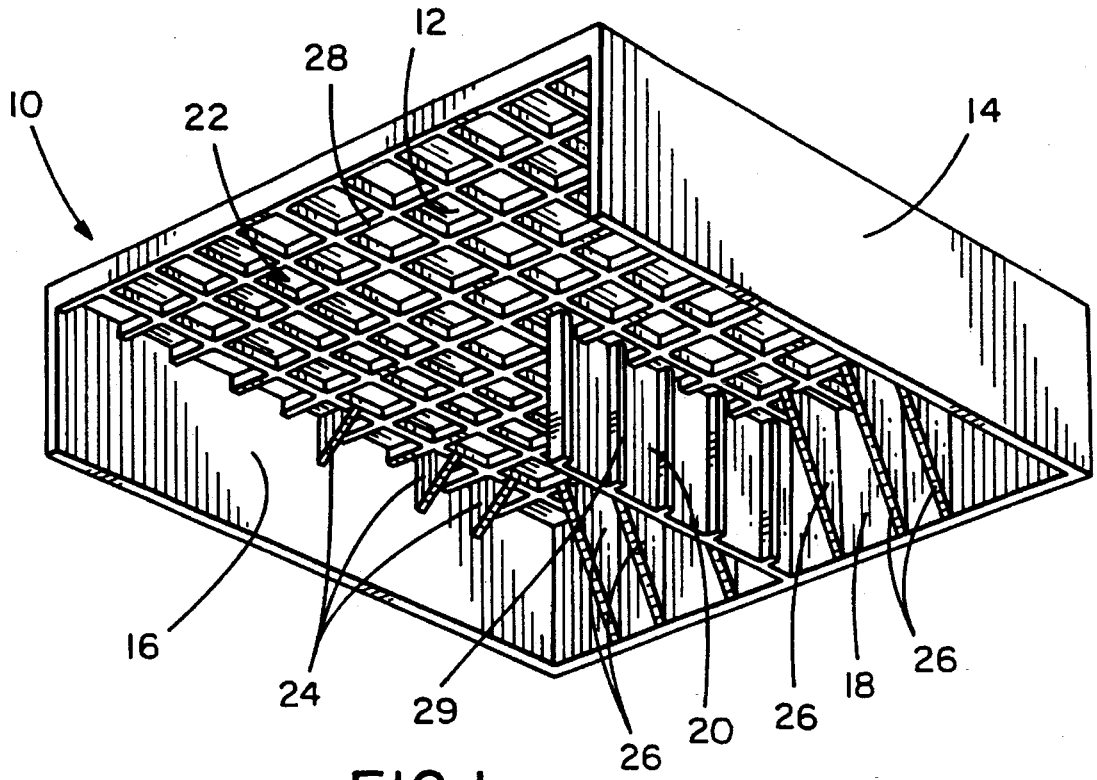
FIG. 1 is a perspective view of an underside portion of a display platform embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
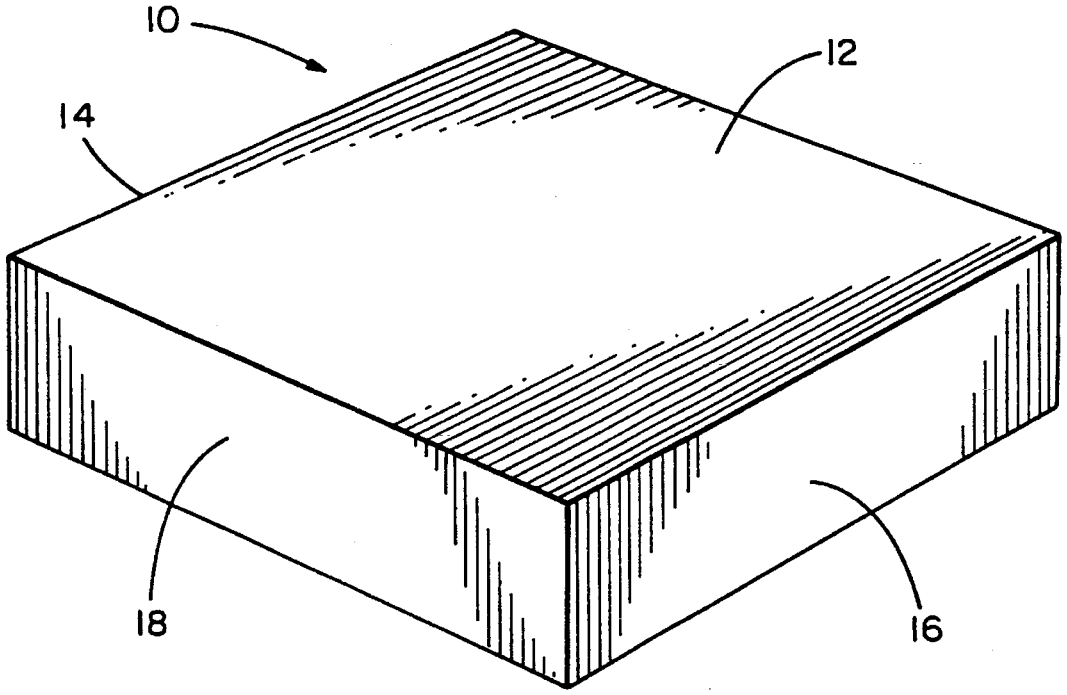
FIG. 2 is a perspective view of an upper portion of the display platform in FIG. 1.
Figure 3:
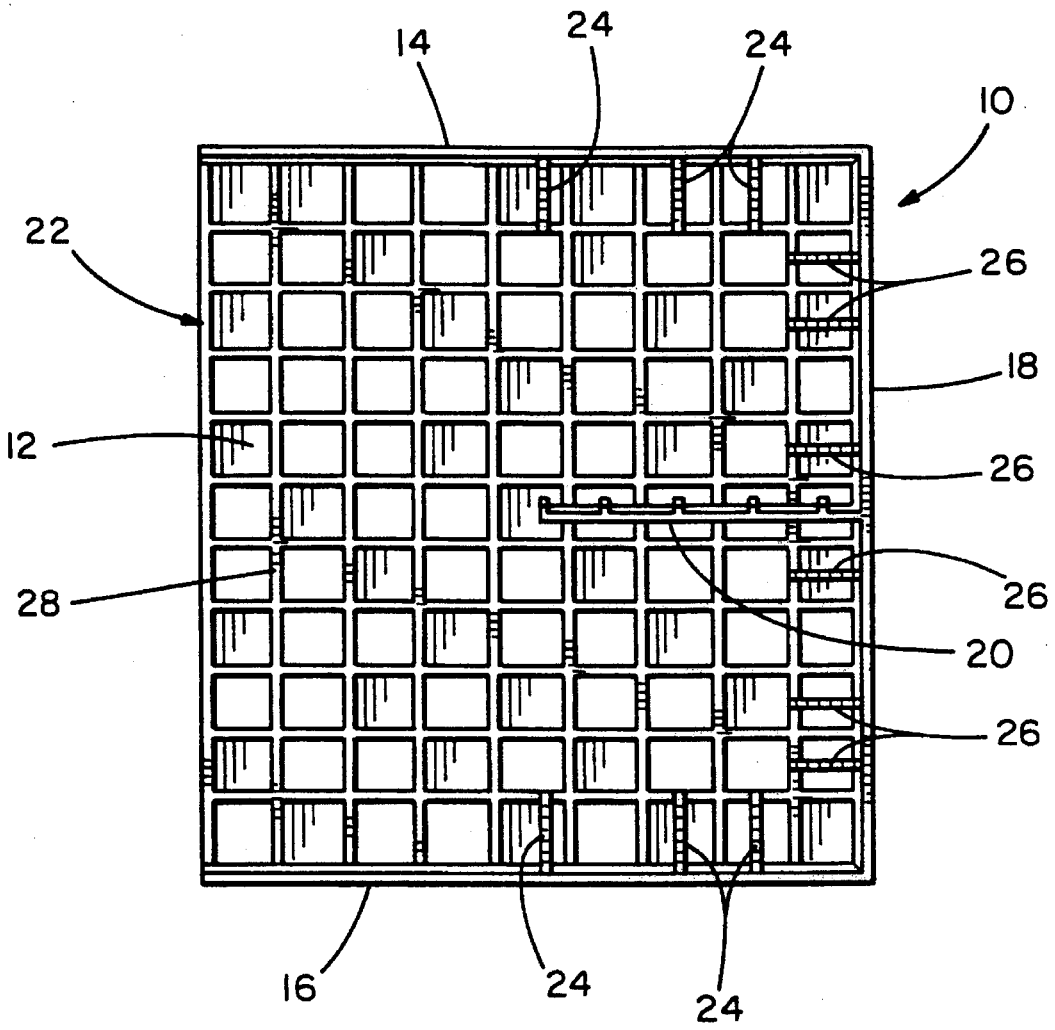
FIG. 3 is a bottom view of the display platform in FIG. 1.
Figure 4:
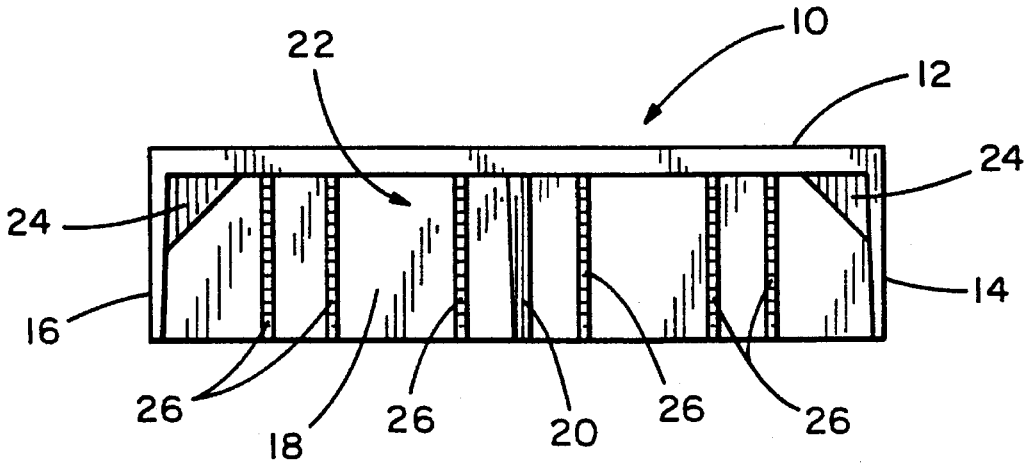
FIG. 4 is an end view of the display platform in FIG. 1.

Turning now to the drawings, FIGS. 1 through 4 illustrate a unitary display platform 10 including a flat horizontal deck 12, a pair of opposing vertical side faces 14, 16, a vertical front face 18, and a vertical support leg 20 disposed midway between the opposing side faces 14, 16. The deck 12, the opposing side faces 14, 16, the front face 18, and the support leg 20 are each generally rectangular in shape. The display platform 10 is preferably free of a vertical rear face opposing the front face 18 so that the display platform 10 defines an opening 22 (FIG. 1) at its rear beneath the horizontal deck 12 and between the side faces 14, 16. The display platform 10 is generally symmetrical about an imaginary vertical plane disposed parallel to and midway between the side faces 14, 16. Such an imaginary vertical plane passes through the vertical support leg 20.

The support leg 20 is generally parallel to the opposing side faces 14, 16. The vertical side faces 14, 16, the vertical front face 18, and the vertical support leg 20 are generally perpendicular to the horizontal deck 12. Moreover, the side faces 14, 16 and the support leg 20 are generally perpendicular to and extend rearward from the front face 18. The length of the support leg 20 is approximately equal to one half of the lengths of the side faces 14, 16. The opposing side faces 14, 16, the front face 18, and the support leg 20 have substantially the same height so that they extend downward by substantially the same extent from the flat horizontal deck 12.

The display platform 10 includes several features which enhance its structural rigidity. First, the support leg 20 provides the horizontal deck 12 with support in its middle region to prevent the horizontal deck 12 from sagging when retail products are loaded thereon. The number of support legs beneath the horizontal deck 12 and between the side faces 14, 16 depends upon the width of the horizontal deck 12 and the stiffness of the material used to form the display platform 10. The wider the horizontal deck 12 and the less stiff the material used to form the platform 10, the greater the number of support legs which would be required to support the horizontal deck 12. These support legs are preferably spaced at equal intervals between the opposing side faces 14, 16. For example, if two support legs are required to reinforce the horizontal deck 12, these support legs would be respectively located at one-third and two-thirds of the distance between the side faces 14, 16. If the horizontal deck 12 is relatively narrow and the material used to form the platform 10 is relatively stiff, the platform 10 might not require any support legs to reinforce the horizontal deck 12.

Second, triangular ribs 24, 26 provide the side faces 14, 16 and the front face 18 with structural strength and stiffness. If the display platform 10 is composed of molded plastic, the triangular ribs 24 are integrally formed with and perpendicular to both the horizontal deck 12 and the side faces 14, 16. Likewise, the triangular ribs 26 are integrally formed with and perpendicular to both the horizontal deck 12 and the front face 18. Each of the triangular ribs 24, 26 is configured as a right-angled triangle with one relatively short leg of the triangle integrally formed with the horizontal deck 12 and the other relatively long leg of the triangle integrally formed with the associated face. In the preferred embodiment, the number of triangular ribs 24 along each of the side faces 14, 16 is equal to three and the number of triangular ribs 26 along the front face 18 is equal to six. Three of the six triangular ribs 26 are located on one side of the central support leg 20, while the remaining three of the six ribs 26 are located on the other side of the central support leg 20. The triangular ribs 24, 26 maintain the side faces 14, 16 and the front face 18 perpendicular to the horizontal deck 12, thereby preventing these faces from bending relative to the horizontal deck 12.

Third, a rectangular grid of ribs 28 is located beneath and integrally formed with the horizontal deck 12. This grid of ribs 28 combines with the support leg 20 to further stiffen the horizontal deck 12.

Fourth, a set of vertical ribs 29 (FIG. 1) is integrally formed with the support leg 20 so as to stiffen that leg 20.

In one embodiment, the deck 12 measures approximately 40 inches (101.7 cm) in width and 36 inches (91.5 cm) in depth. Accordingly, the front face 18 has a length of approximately 40 inches (101.7 cm), and the side faces 14, 16 have respective lengths of approximately 36 inches (91.5 cm). Since the length of the support leg 20 is approximately one half of the length of each side face 14, 16, the support leg 20 has a length of approximately 18 inches (45.8 cm). Finally, the side faces 14, 16, the front face 18, and the support leg 20 have respective heights of approximately 10 inches (25.4 cm).

The display platform 10 is preferably composed of a stiff moldable material such as recycled or virgin plastic (e.g., polyethylene). In one embodiment, the display platform 10 is made of a minimum of 50% post-consumer recycled high-density polyethylene plastic. Formed from this plastic, the display platform 10 weighs approximately 48 pounds. The molded plastic is sufficiently durable to resist scratches and dents from shopping carts and protect retail products from daily mopping and accidental spills. Moreover, the molded plastic is inert to most chemicals and petroleum products, will not absorb moisture or retain bacterial contamination, and is easily cleaned. The one-piece design of the display platform 10 eliminates nail/screw heads and splinters to protect the retail products as well as retail store personnel.

The plastic display platform 10 is preferably manufactured using conventional injection molding techniques. To facilitate release of the display platform 10 from the mold during the injection molding process, the side faces 14, 16, the front face 18, and the support leg 20 are preferably tapered from their upper ends to their lower ends (see FIG. 4). In other words, the side faces 14, 16, the front face 18, and the support leg 20 get narrower in a direction extending away from the horizontal deck 12. The side faces 14, 16 and the front face 18 are tapered such that the outer surfaces thereof are almost exactly perpendicular to the horizontal deck 12, while the inner surfaces of these faces are disposed slightly greater than 90 degrees away from the lower surface of the deck 12. Each of the two surfaces of the support leg 20 is disposed slightly greater than 90 degrees away from its respective neighboring portion of the lower surface of the horizontal deck 12.

After the display platform 10 has been released from the mold, the triangular ribs 24, 26 and the rectangular grid of ribs 28 assist in maintaining the shape of display platform 10 while it cures, thereby preventing warping or deformation of the display platform 10.

Figure 5:
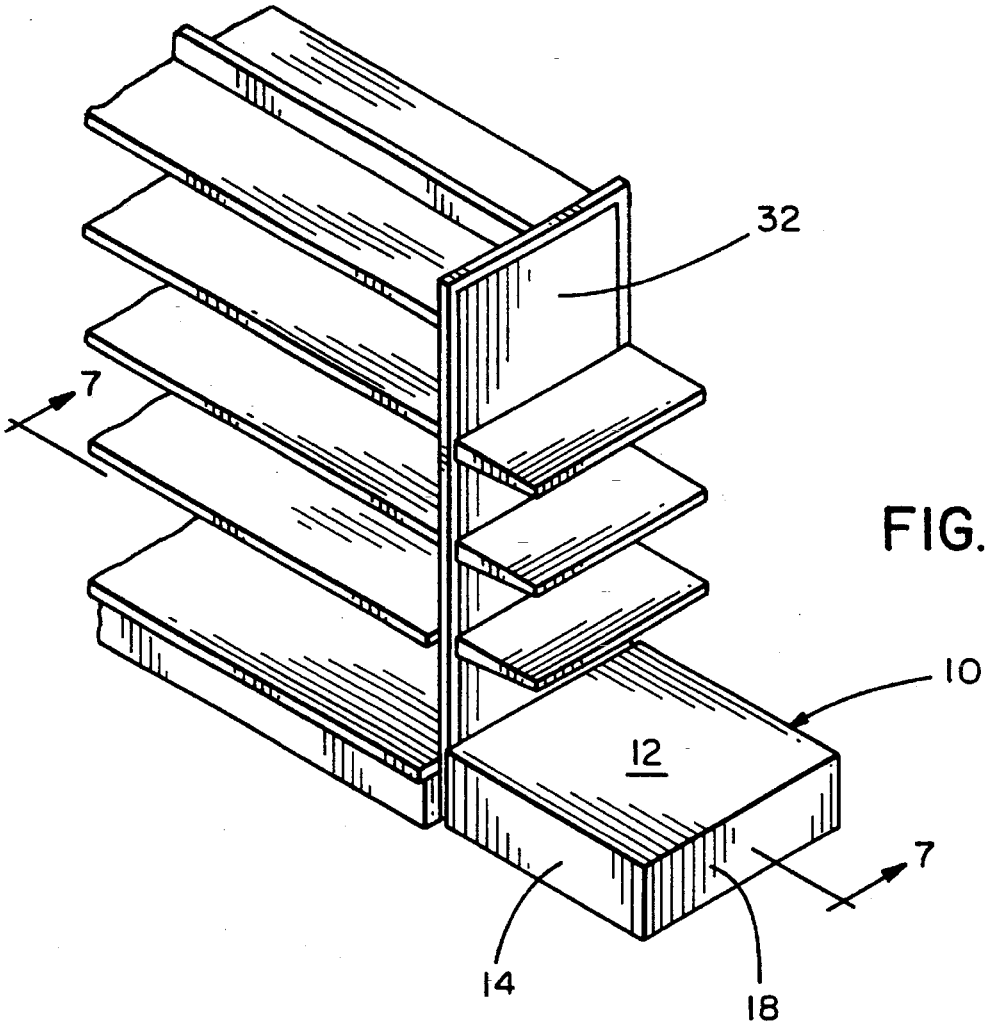
FIG. 5 is a perspective view of the display platform in FIG. 1 showing the display platform placed over a shelf of an end aisle display.
Figure 6:
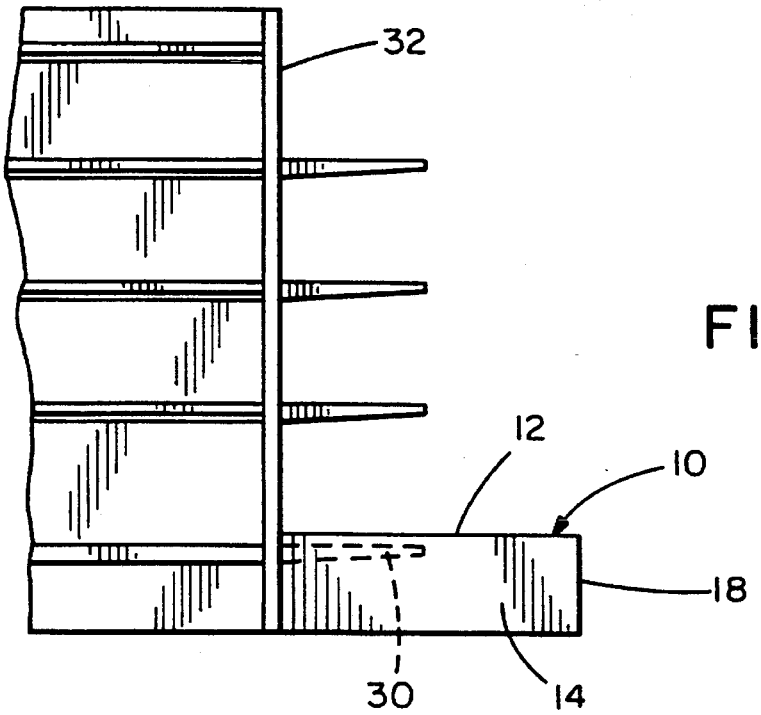
FIG. 6 is a side view of the display platform in FIG. 1 showing the display platform placed over a shelf of an end aisle display.
Figure 7:
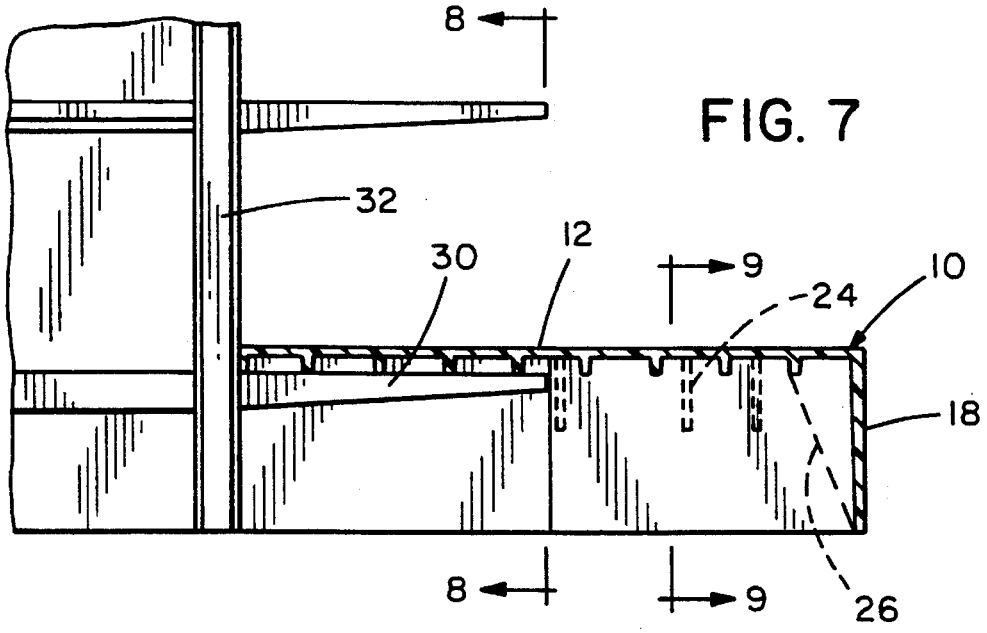
FIG. 7 is a section taken generally along line 7—7 in FIG. 5.
Figure 8:
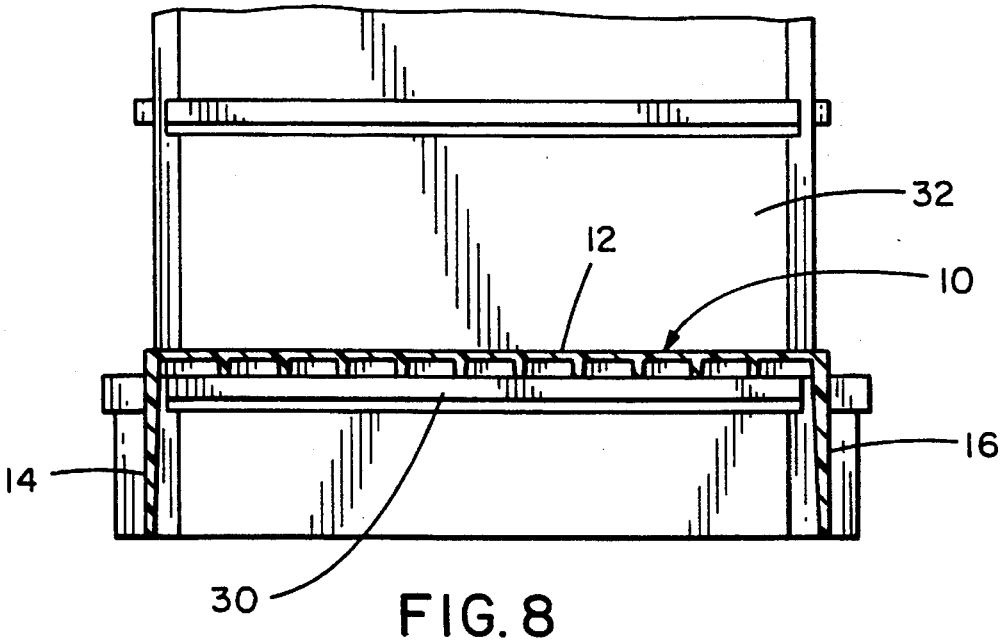
FIG. 8 is a section taken generally along line 8—8 in FIG. 7.
Figure 9:
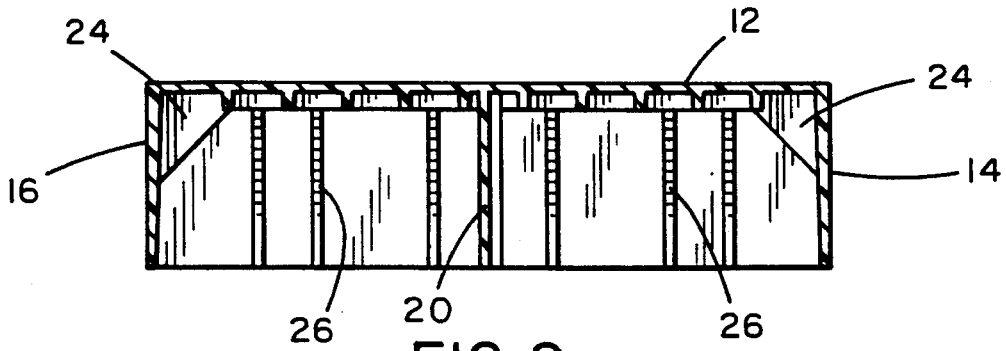
FIG. 9 is a section taken generally along line 9—9 in FIG. 7.

Referring now to FIGS. 5 through 9, the display platform 10 is intended to be used in the retail business to promote retail products which require more display space than can be provided by conventional shelves located on stand alone displays or end aisle displays. With respect to an end aisle display, the display platform 10 slips over an existing lowermost shelf 30 (FIGS. 6–8) such that: (1) the shelf 30 protrudes through the rear opening 22; (2) the front edge of the shelf 30 abuts the rear edge of the support leg 20; (3) the lower rear portion of the horizontal deck 12 abuts the upper surface of the shelf 30; and (4) the side faces 14, 16, the front face 18, and the support leg 20 rest on the floor. The height of the upper surface of the shelf 30 above the floor preferably conforms to the heights of the side faces 14, 16, the front face 18, and the support leg 20. In other words, the upper surface of the shelf 30 is spaced from the floor by a vertical distance no greater than, and preferably equal to, the height of the lower surface of the horizontal deck 12 above the floor.

Since the horizontal deck 12 is larger than the shelf 30, the display platform 10 provides more display space for retail products than that provided by the shelf 30 on its own. For example, if the shelf is 38 inches (95.6 cm) wide and 18 inches (45.8 cm) deep, the display platform 10 expands this display space to a width of 40 inches (101.7 cm) and a depth of 36 inches (91.5 cm), i.e., the preferred approximate dimensions of the deck 12. Thus, the display platform 10 more than doubles the display space provided by the shelf 30 on its own.

Retail products may be loaded onto the display platform. 10 either before or after the platform 10 is slipped over the shelf 30. If the retail products are loaded onto the platform 10 prior to slipping the platform 10 over the shelf 30, the upper surface of the deck 12 is preferably textured to prevent the retail products from skidding off the deck 12 during movement of the platform 10. If the retail products are loaded onto the platform 10 after slipping the platform 10 over the shelf 30, the upper surface of the deck 12 need not be textured for skid resistance. It has been found, however, that such a textured surface is nonetheless desirable because it obscures flow lines generated by the injection molding process described above. Thus, the textured surface of the deck 12 enhances the aesthetic appeal of the display platform 10.

The front face 18 further enhances the aesthetic appeal of the display platform 10 by providing the display platform 10 with a neat, finished appearance. With the front face 18, the display platform 10 has defined faces along its entire viewable periphery in FIG. 5. Since the rear edges of the deck 12 and the side faces 14, 16 contact the shelf support wall 32, the rear opening 22 is concealed so as to not diminish the appearance of the display platform 10.

While the present invention has been described with reference to one or more particular embodiments, those skilled in the art will recognize that many changes may be made thereto without departing from the spirit and scope of the present invention. For example, the display platform 10 may be composed of other stiff materials such as wood, corrugated board, fiberboard, or fiberglass. Each of these embodiments and obvious variations thereof is contemplated as falling within the spirit and scope of the claimed invention, which is set forth in the following claims.

What is claimed is:

1. A unitary display platform, comprising:

a horizontal deck for supporting items thereon;

a pair of generally parallel opposing vertical side faces extending downward from the horizontal deck;

a vertical front face bridging the opposing side faces and extending downward from the horizontal deck; and a vertical support leg disposed between the opposing side faces and extending downwardly from the horizontal deck, the support leg being shorter in length than each of the opposing side faces;

wherein the horizontal deck and the opposing side faces form a rear opening to accommodate a lower shelf on an end aisle display within said opening.

2. The display platform of claim 1, wherein the opposing side faces, the front face, and the support leg extend downward by substantially the same extent from the horizontal deck.

3. The display platform of claim 1, wherein the support leg is generally parallel to the opposing side faces, and wherein the side faces and the support leg are generally perpendicular to the front face and extend rearward from the front face.

4. The display platform of claim 3, wherein the support leg is located approximately midway between the opposing side faces.

5. The display platform of claim 4, wherein the display platform is substantially symmetrical about an imaginary vertical plane parallel to and located midway between the opposing side faces.

6. The display platform of claim 1, wherein the rear opening is approximately the same size as the front face.

7. The display platform of claim 1, wherein the support leg is approximately one-half the length of each of the opposing side faces.

8. The display platform of claim 1, wherein the display platform is composed of molded plastic.

9. The display platform of claim 8, wherein the side faces, the front face, and the support leg taper in a direction extending away from the horizontal deck.

10. The display platform of claim 1, wherein a first plurality of ribs bridge the horizontal deck and each of the side faces, and wherein a second plurality of ribs bridge the horizontal deck and the front face.

11. The display platform of claim 10, wherein a rectangular grid of ribs are integrally formed with a lower surface of the horizontal deck.

12. A unitary display platform, comprising:

a unitary display platform, comprising:

a horizontal deck for supporting items thereon;

a pair of generally parallel opposing vertical side faces extending downward from the horizontal deck;

a vertical front face bridging the opposing side faces and extending downward from the horizontal deck, the front face being generally perpendicular to the opposing side faces; and a vertical support leg disposed between and generally parallel to the opposing side faces and extending downward from the horizontal deck, the support leg being shorter in length than each of the opposing side faces, the support leg, the side faces, and the front face having approximately the same height such that the support leg, the side faces, and the front face extend downwardly by substantially the same extent from the horizontal deck;

wherein the display platform is composed of molded plastic and forms a rear opening beneath the horizontal deck and between rear edges of the opposing side faces to accommodate a lower shelf on an end aisle display within said opening.

13. The display platform of claim 12, wherein the horizontal deck is generally rectangular in shape.

14. The display platform of claim 12, wherein the support leg is located approximately midway between the opposing side faces.

15. The display platform of claim 14, wherein the support leg is approximately one-half the length of each of the opposing side faces.

16. The display platform of claim 12, wherein the display platform is substantially symmetrical about an imaginary vertical plane parallel to and located midway between the opposing side faces.

17. The display platform of claim 12, wherein the side faces, the front face, and the support leg taper in a direction extending away from the horizontal deck.

18. A method of providing a display platform in a store, the display platform including (a) a horizontal deck, (b) a pair of generally parallel opposing vertical side faces extending downward from the horizontal deck, (c) a vertical front face bridging the opposing side faces and extending downward from the horizontal deck, and (d) a vertical support leg disposed between the opposing side faces and extending downward from the horizontal deck, the support leg being shorter in length than each of the opposing side faces, the display platform forming a rear opening beneath the horizontal deck and between rear edges of the opposing side faces, the method comprising the steps of:

providing a horizontal store shelf projecting over a store floor, the store shelf being spaced from the floor by a vertical distance no greater than a height of the horizontal deck above the floor when the display platform is resting on the floor;

placing the display platform over the store shelf with the shelf protruding through the rear opening and the side faces, the front face, and the support leg resting on the floor; and loading items on an upper surface of the horizontal deck.

19. The method of claim 18, wherein a front edge of the shelf abuts a rear edge of the support leg when the display platform is placed over the shelf.

20. The method of claim 18, wherein a rear portion of a lower surface of the horizontal deck abuts an upper surface of the shelf when the display platform is placed over the shelf.

21. The method of claim 18, wherein the store shelf is located at an end of an aisle.

22. The method of claim 18, wherein the surface area of an upper surface of the horizontal deck is at least twice the surface area of an upper surface of the shelf.

* * * * *